US007180492B2

(12) United States Patent
Shih et al.

(10) Patent No.: US 7,180,492 B2
(45) Date of Patent: Feb. 20, 2007

(54) SCAN DRIVING CIRCUIT WITH SINGLE-TYPE TRANSISTORS

(75) Inventors: Jun-Ren Shih, Hsinchu (TW); Ming-Daw Chen, Hsinchu (TW); Shang-Li Chen, Hsinchu (TW); Chun-Fu Chung, Hsinchu (TW)

(73) Assignee: Industrial Technology Research Institute, Chutung Hsinchu (TW)

( * ) Notice: Subject to any disclaimer, the term of this patent is extended or adjusted under 35 U.S.C. 154(b) by 398 days.

(21) Appl. No.: 10/653,991

(22) Filed: Sep. 4, 2003

(65) Prior Publication Data

US 2004/0252094 A1 Dec. 16, 2004

(30) Foreign Application Priority Data

Jun. 12, 2003 (TW) ..... 92115939 A

(51) Int. Cl.
*G09G 3/36* (2006.01)

(52) U.S. Cl. ..... 345/92; 345/98

(58) Field of Classification Search ..... 345/99–100, 345/204, 87, 92, 98; 349/42
See application file for complete search history.

(56) References Cited

U.S. PATENT DOCUMENTS

| | | | | |
|---|---|---|---|---|
| 5,726,720 | A * | 3/1998 | Watanabe et al. | 349/43 |
| 6,064,364 | A * | 5/2000 | Katoh et al. | 345/100 |
| 6,621,481 | B1 * | 9/2003 | Kanbara | 345/100 |
| 6,829,322 | B2 * | 12/2004 | Shih et al. | 377/78 |
| 2003/0128180 | A1 * | 7/2003 | Kim et al. | 345/100 |

* cited by examiner

*Primary Examiner*—Kent Chang
(74) *Attorney, Agent, or Firm*—Bacon & Thomas, PLLC

(57) ABSTRACT

A single-type thin-film transistor (TFT) is used for making a thin-film transistor liquid crystal display (TFT-LCD). The scan driving circuit of the liquid crystal display is made of P-type thin-film transistors or N-type thin-film transistors so as to decrease the steps required by the manufacture process and reduce the cost and the probability of error occurring.

17 Claims, 8 Drawing Sheets

SCAN DRIVING CIRCUIT WITH SINGLE-TYPE TRANSISTORS

BACKGROUND OF THE INVENTION

1. Field of the Invention

The present invention relates to a scan driving circuit with single-type transistors. The thin-film transistor liquid crystal display (TFT-LCD) is manufactured by using the single-type thin-film transistor.

2. Description of the Prior Art

As the basic science and application technology continuously advance and develop, the human life is unceasingly getting better. An example is the technology for the image display of television. The television could only display the images with block and white colors in the very early days, but at present, the colorful television set is so common that every family owns one or more while in the past, there might be only one television set in one community, and all of the people in the community watched the same one. However, as several decades have passed, the general television is no longer sufficient to satisfy the needs of the consumer. Because of the usage of the space and the change of the concept, the liquid crystal display has been developed and improved so as to match the requirements in the future.

Because the liquid crystal display has the characteristics of space and radiation, in order to strengthen its advantages, the liquid crystal display made of thin-film transistors has been developed and presented so as to reduce the occupied space. This allows the user to make use of the space more efficiently.

However, the prior art liquid crystal display has drawbacks. For example, in the scan line with resolution of 1280×1024, the required number of the scan driving signal is 1024, and the prior art method is performed by using a 1024-rank logic array circuit. However, such scheme has the following disadvantages.

The area of the 1024-rank logic array circuit is excessively great, and when one of the 1024 ranks of the logic array circuit is erroneous, the display frame following the erroneous rank cannot be normally displayed.

Furthermore, please refer to FIG. 1. FIG. 1 shows a prior art scan driving circuit. In the left side of the figure, there is a power line 20 for providing the power for the circuit, and in the right side of the figure, there is a grounding line 21 connected to the circuit. Besides the power line 20 and the grounding line 21, there is a scan driving circuit of the display, and the circuit comprises three different banks of control signal inputs (W1~4' N1~4' G1~4) so as to drive the connected 16 banks of scan circuit units 1~16. By means of the connection of the different scan lines 24, 25, 26, the column circuits 27 are driven to perform the image scanning. In the prior art, in order to avoid the drawbacks of the mentioned 1024-rank logic array circuit, the two (N1~4' G1~4) of the three banks of the scan line circuits have the same logic signals to be operated in an inverse mode. Therefore, the circuit of FIG. 1 still has the disadvantage of complication. In addition, the signals are easily interrupted because of the multiple output terminals.

Please refer to FIG. 2. FIG. 2 is a perspective diagram of another prior art circuit. As shown in this figure, while performing the scanning, by means of the connection of the circuit and the output of the logic signal of the transistor, the scanning of the images are controlled and driven. However, the connection of the circuit substantially requires more than three banks of control signals. In addition, the connection of the transistor and the array circuit is so complicated that the connection of the circuit is not simplified effectively.

SUMMARY OF THE INVENTION

The present invention provides a scan driving circuit with single-type transistors so as to resolve the problems in the prior art. In the present invention, the single-type thin-film transistors are used for designing the thin-film transistor display. Therefore, the required steps for manufacturing the thin-film transistor display can be decreased, the cost for manufacturing reduced, and the probability of error occurring can be diminished so as to promote the yield and reduce the number of the optical masks required in the manufacture process.

The present invention provides a 16-rank scan driving circuit, and two banks of clock signals (control signals) are inputted for driving the scanning. This method is used for inputting two banks of clock signals into different logic circuit units by means of the connection of the array circuit. In the different logic circuit units, after performing the processing by using the received control clock signals, the clock signals for controlling are outputted so as to accomplish the driving of the scanning.

By using the above-mentioned method and the connection of the circuit, the drawbacks of the prior art can be overcome effectively so as to promote the efficiency of the whole scheme.

BRIEF DESCRIPTION OF THE DRAWINGS

The accompanying drawings, which are incorporated in and form part of the specification in which like numerals designate like parts, illustrate preferred embodiments of the present invention and together with the description, serve to explain the principles of the invention. In the drawings.

DETAILED DESCRIPTION OF THE PREFERRED EMBODIMENT

Figure 1:
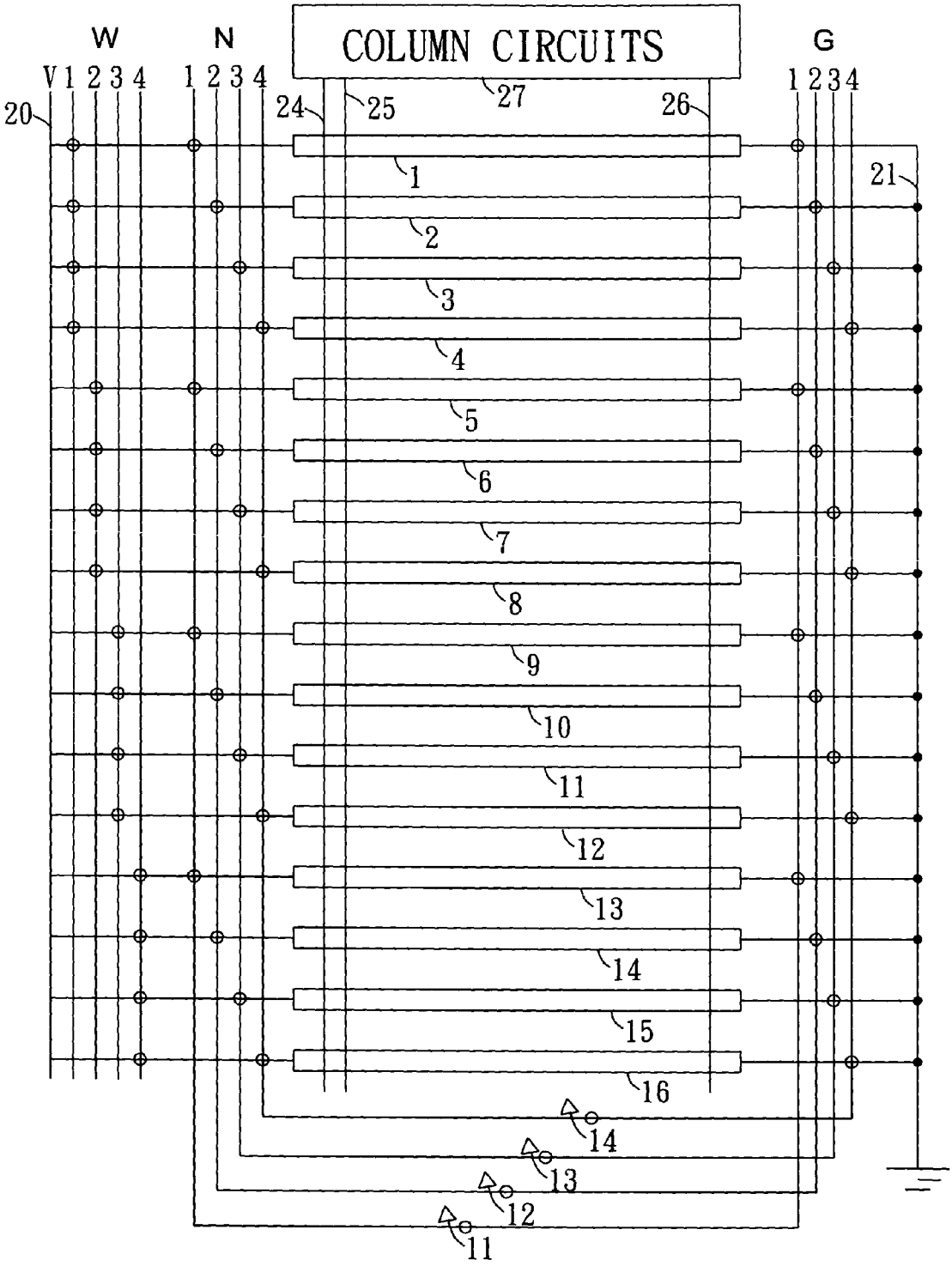
FIG. 1 (PRIOR ART)
FIG. 1 is a schematic diagram of a prior art circuit.
Figure 2:
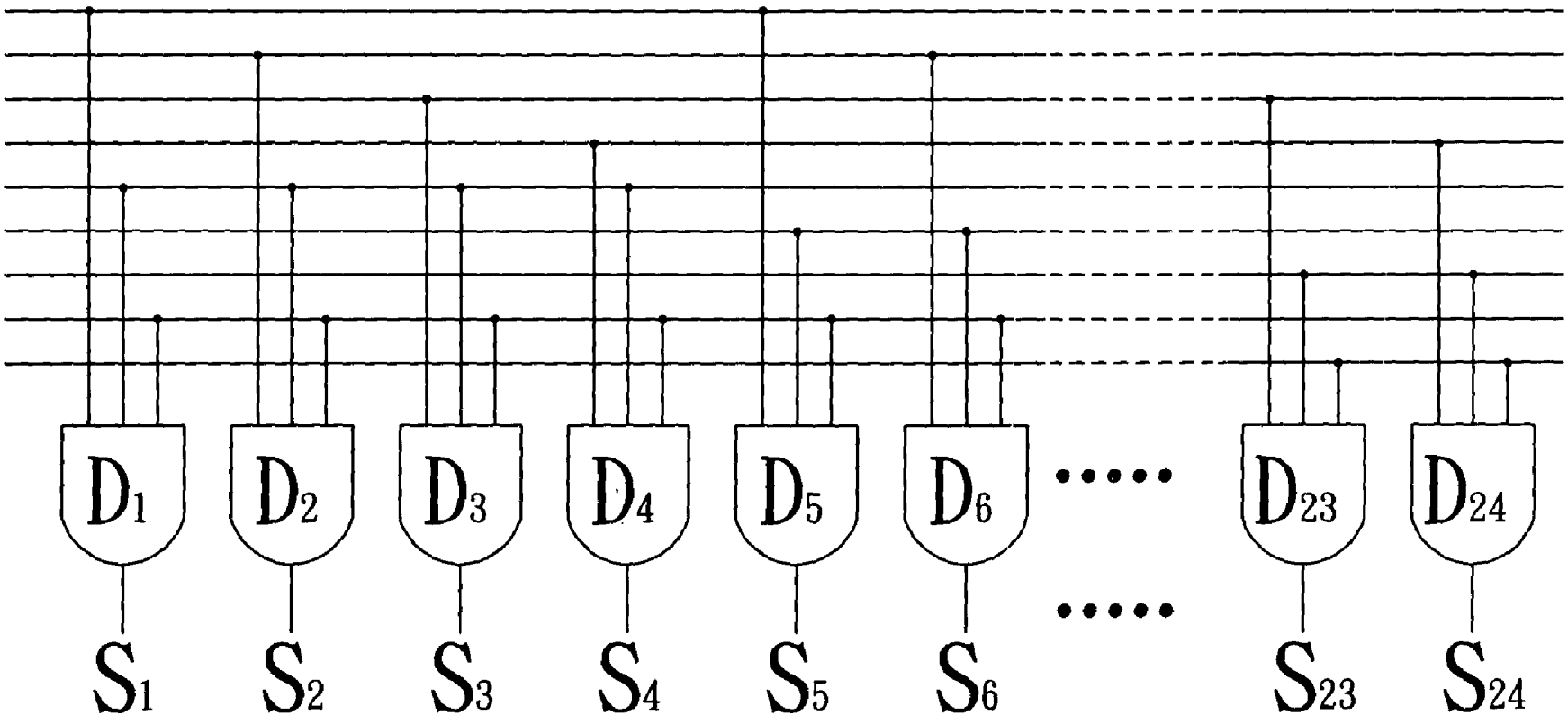
FIG. 2 (PRIOR ART)
FIG. 2 is a schematic diagram of another prior art circuit.
Figure 3:
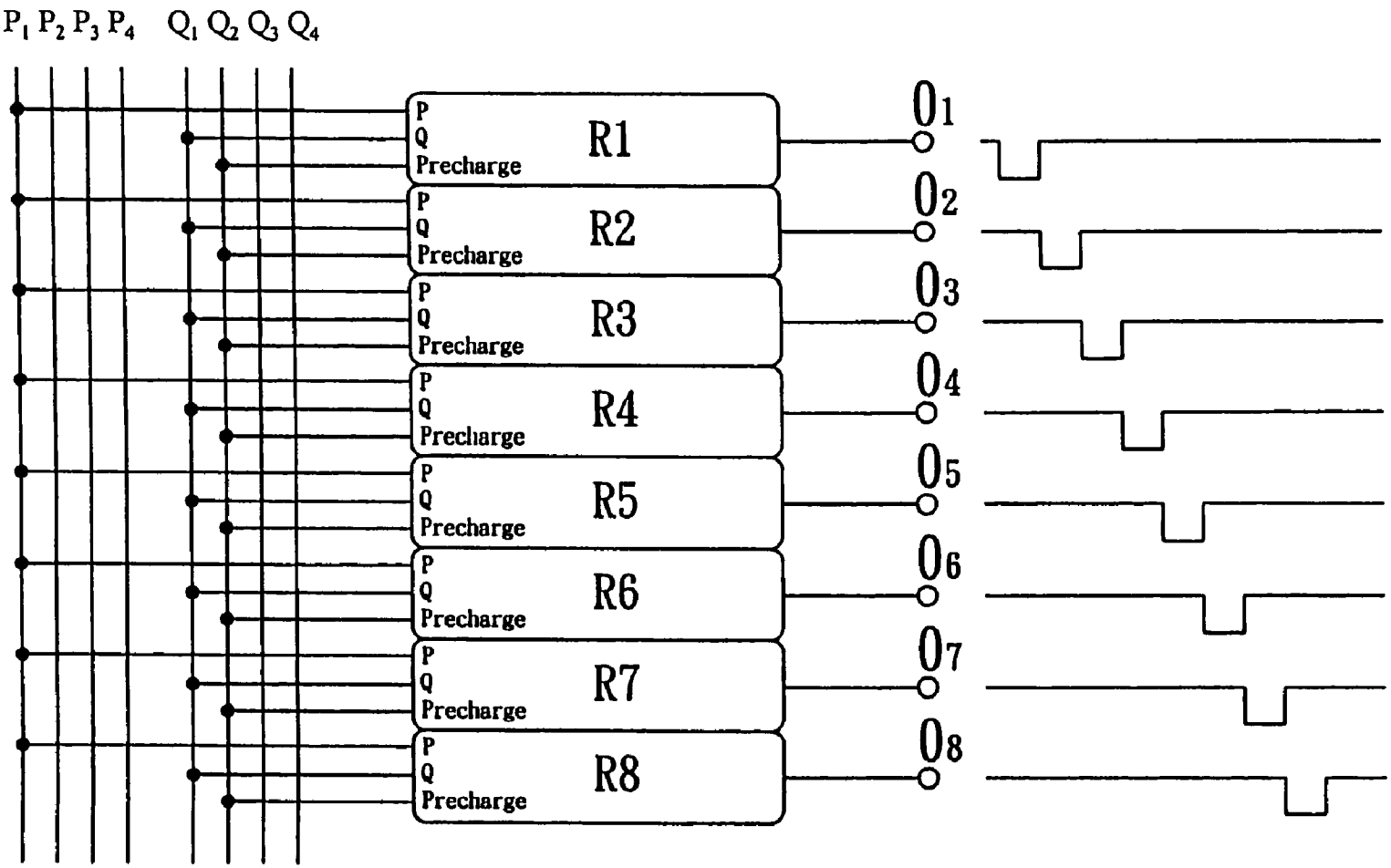
FIG. 3 is a schematic diagram of a circuit structure according to a first embodiment of the present invention.

The present invention relates to a scan driving circuit with single-type transistors. The single-type thin-film transistors are used for manufacturing the thin-film transistor liquid crystal display. Please refer to FIG. 3. FIG. 3 is a schematic diagram of a circuit structure of a scan driving circuit with single-type transistors according to a first embodiment of the present invention. The scan driving circuit comprises a first clock input bank. This first clock input bank is composed of a plurality of input clocks, including a first input clock P1, a second input clock P2, a third input clock P3 and a fourth input clock P4. The plurality of different input clocks P1~P4 are used for connecting first input ends $P_{R1}$~$P_{R8}$ of logic circuit units R1~R8 in the nth rank logic circuit bank. Besides the first clock input bank, a second clock input bank is included. This second clock input bank has a fifth input clock Q1, a sixth input clock Q2, a seventh input clock Q3 and an eighth input clock Q4, and is connected to second input ends $Q_{R1}$~$Q_{R8}$ of logic circuit units R1~R8 in the nth rank logic circuit bank.

As mentioned above, when the logic circuit units R1~R8 of the logic circuit bank receive the plurality of input clocks P1~P4, Q1~Q4 transmitted from the different clock input banks, the logic circuit in the transistor will process and perform operations on the clocks. The different output control clock signals $O_{R1}$~$O_{R8}$ are obtained. The relationships between the input clocks P1~P4, Q1~Q4 and output control clock signals $O_{R1}$~$O_{R8}$ will be described in FIG. 4. The logic circuit units R1~R8 comprises first input ends $P_{R1}$~$P_{R8}$ and second input end $Q_{R1}$~$Q_{R8}$ for separately receiving the first input clock bank and the second input clock bank. In addition, front ends $Precharge_{R1}$~$Precharge_{R8}$ and output ends $O_{R1}$~$O_{R8}$ are comprised, and the input ends $P_{R1}$~$P_{R8}$, $Q_{R1}$~$Q_{R8}$ of the scan driving circuit are used for receiving the control signals for signal outputting with different clocks. The output ends $O_{R1}$~$O_{R8}$ are used for outputting the control signals to drive the display units of the liquid crystal display.

Figure 4:
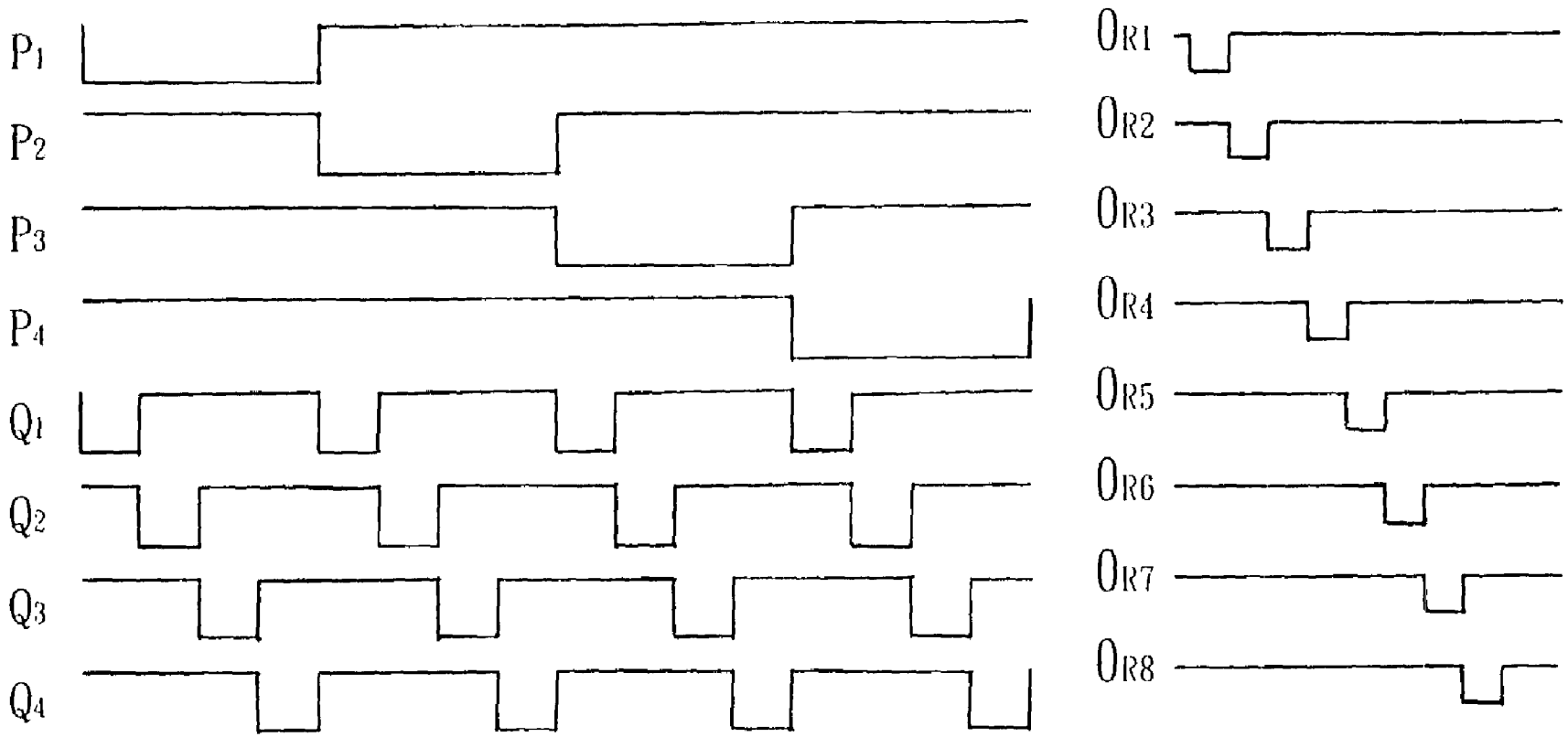
FIG. 4 is schematic diagram showing the inputting/outputting of signals according to the first embodiment of the present invention.

Next, please refer to FIG. 4. FIG. 4 is a schematic diagram showing the inputting/outputting of signals according to the first embodiment of the present invention. As shown in this figure, because the P type transistors are used in the circuit of the present invention, in the portion of input clock, the low-level clock signals are used for controlling the processing and operations of the transistor. The first to fourth input clocks P1~P4 are continuously long low-level clock signals. Namely, the clock low-level pulses of the fifth to eighth input clocks Q1~Q4 occur in the time slots where the low-level pulses of the long low-level clock signals P1~P4. The first to eight input clocks P1~P4, Q1~Q4 are inputted to be processed by the logic circuit units via the logic operations. Therefore, the logic output control clock signals $O_{R1}$~$O_{R8}$ for different low-level clock pulses are obtained.

Figure 5:
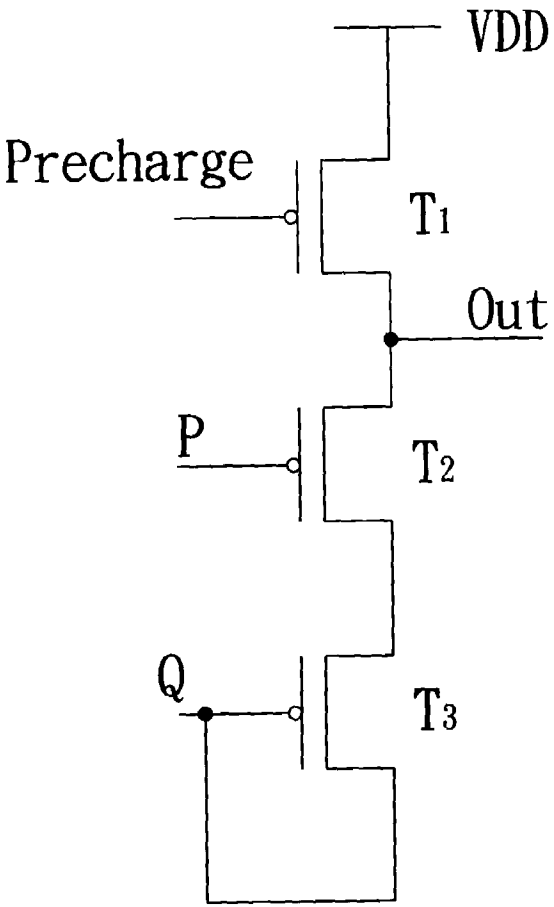
FIG. 5 is a first connection diagram of a logic circuit unit transistor according the embodiment of the present invention.

Please refer to FIG. 5. FIG. 5 is a first connection diagram of a logic circuit unit transistor according to the embodiment of the present invention. Each of the logic control units has three transistors, and all of the transistors used by the embodiment of the present invention are P type transistors. Therefore, as described in FIG. 4, the low-level signals are inputted to control the plurality of logic circuit units for performing the logic operations in the practical application, the first transistor T1 is the signal input end of the front end Precharge, and is connected to the second transistor T2. The second transistor T2 is the signal input end of the first input clock bank, comprises a first input end P, and is connected to the first transistor T1 and third transistor T3. Finally, the third transistor T3 is the signal input end of the second input clock bank, and comprises a second input end Q. The drain of the third transistor T3 is connected to its source. By means of the above circuit connection, the first transistor T1 and the second transistor T2 are connected to the output Out.

Figure 6:
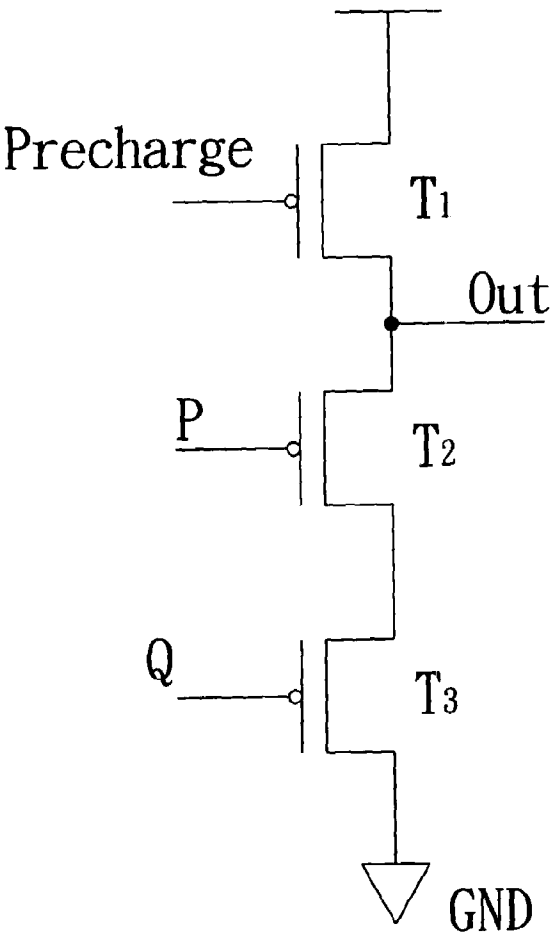
FIG. 6 is a second connection diagram of a logic circuit unit transistor according the embodiment of the present invention.

Please refer to FIG. 6. FIG. 6 is a second connection diagram of a logic circuit unit transistor according to the embodiment of the present invention. The second connection is similar to the first connection shown in FIG. 5, and the difference between them is that the drain of the third transistor T3 is not connected to its source, and is grounded so as to finish the circuit design.

Figure 7:
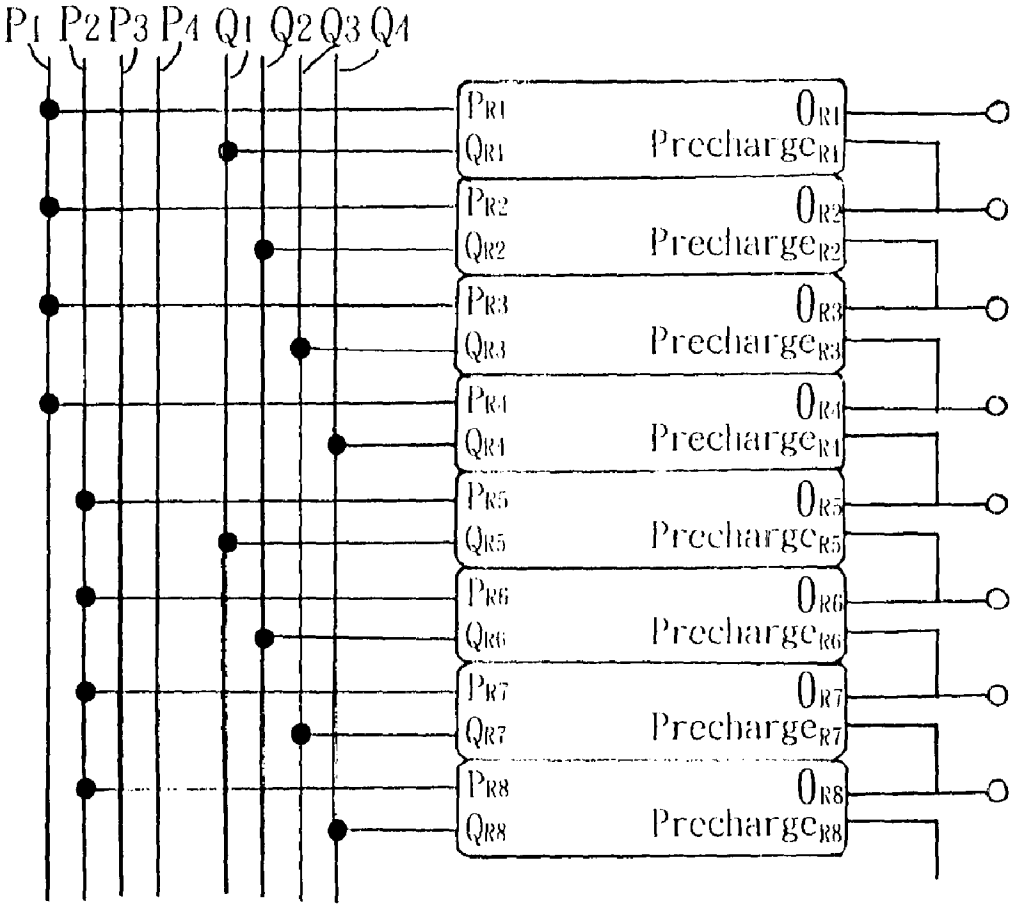
FIG. 7 is a perspective diagram of a circuit structure according to a second embodiment of the present invention.

Please refer to FIG. 7. FIG. 7 is a perspective diagram of a circuit structure according to a second embodiment of the present invention. The second embodiment is similar to the first one. The difference between them is that in the second embodiment, the front end Precharge of one of the logic circuit units is connected to the output end $O_{R1}$~$O_{R8}$ of another logic circuit unit R1~R8. The remaining portions are the same as those in the first embodiment, and they will not be described herein.

Similarly, the transistors of the logic unit circuit used in the second embodiment can be connected in the same way as the circuit connection method in FIGS. 5 and 6.

Figure 8:
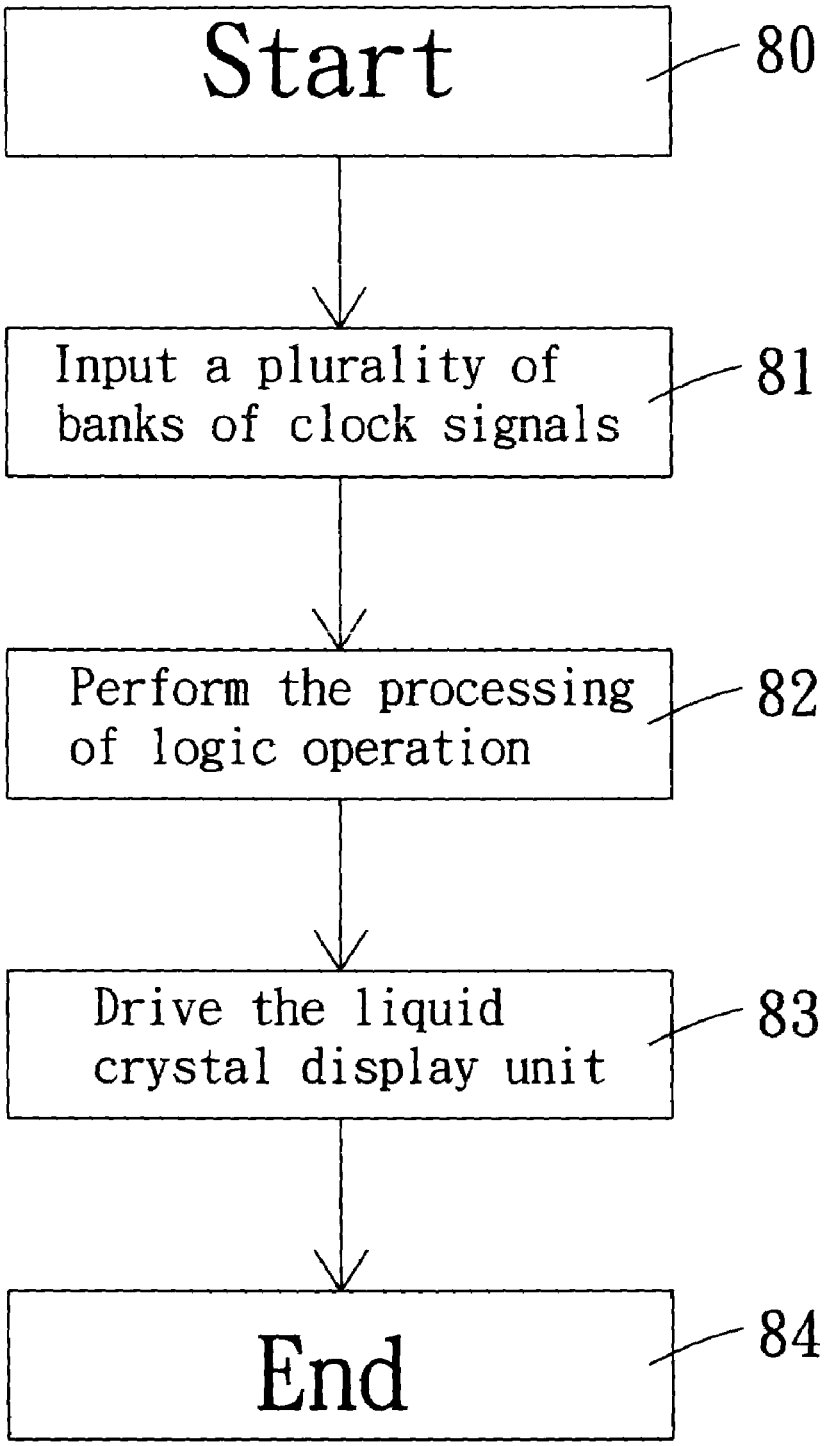
FIG. 8 is a flowchart showing the operation according to the embodiment of the present invention.

Next, please refer to FIG. 8. FIG. 8 is a flowchart showing the operation according to the embodiment of the present invention. The operation comprises the following steps. In the step 80, the operation is started up so as to perform the processing of the logic control signal. In the step 81, input a plurality of banks of clock signals. The banks include a first clock input bank and a second clock input bank for inputting logic signals. By means of the circuit connection in the array mode, the clock signals are inputted into the plurality of logic circuit units. Then, in the step 82, perform the processing of logic operations. By using the plurality of logic circuit units, the logic control signals are processed to perform the operations. The control signals for driving the scanning are outputted to drive the liquid crystal display unit 83 so as to finish the processing and outputting of the driving scan signal for the display.

As mentioned in the description for the circuit and the operation flowchart, the two different banks of input clocks P1~P4, Q1~Q4 in the present invention are inputted to the different logic circuit units in an array circuit mode. By means of the logic operations on the transistors, the control signals for driving the scanning can be outputted. Because the mentioned input clock signals are the clock signals driven by the low-level pulses, the P type single-type transistors are used. However, practically, the N type transistors are used in the circuit design. Therefore, the clock signals driven by the high-level pulses are used to be the inputted clocks.

Figure 9:
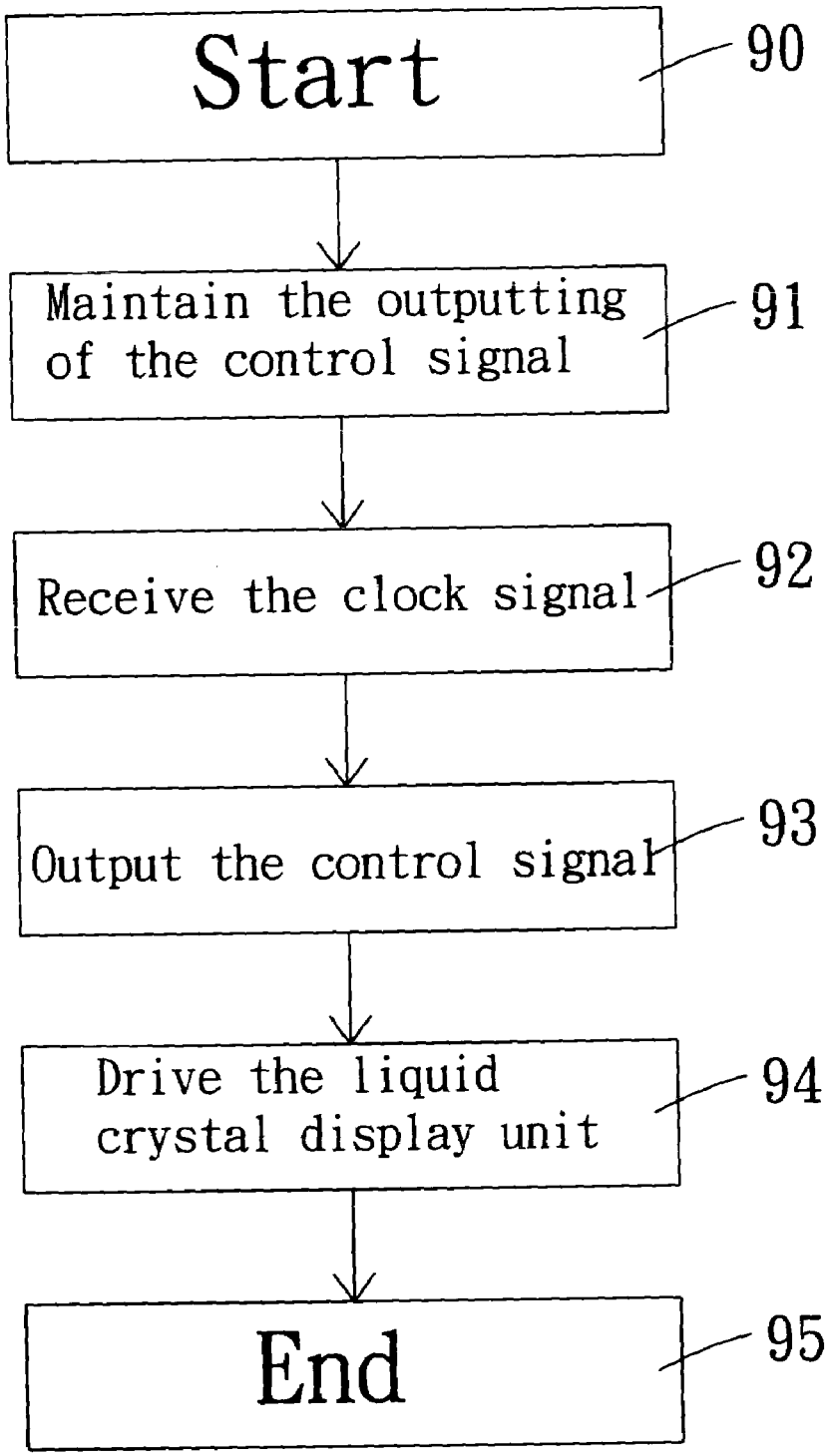
FIG. 9 is a flowchart showing the scanning operation performed by the logic circuit unit according to the embodiment of the present invention.

Please refer to FIG. 9. FIG. 9 is a flowchart of the scanning operation performed by the logic circuit unit according to the present invention. In the step 90, the operation is started up. The outputting of the control signals is maintained in the step 91. After the front end Precharge of the first transistor continuously output the control signals, the second transistor and the third transistor are used for separately receiving the clock signals in the step 92. The clock signals include the input clock signals of the first clock input bank and the output clock signals of the second clock input bank. After the signals are processed in the transistors, the output ends connected to the drains of the first transistor and the second transistor output the control signals in the step 93. The control signals will drive the liquid crystal display unit 94 so as to finish the processing of the logic signals for driving the scanning in the step 95.

Those skilled in the art will readily observe that numerous modifications and alterations of the device may be made while retaining the teachings of the invention. Accordingly, the above disclosure should be construed as limited only by the metes and bounds of the appended

What is claimed is:

1. A scan driving circuit with single-type transistors using a liquid crystal display made of single-type thin-film transistors, the scan driving circuit comprising:

a first clock input bank comprising a plurality of input signals with different clocks, and connected to a first input end in an nth rank logic circuit; a second clock input bank comprising a plurality of input signals with different clocks, and connected to a second input end in the nth rank logic circuit;

wherein said logic circuit includes a plurality of logic circuit units, each of the logic circuit units comprising the first input end, the second input end, a front end and an output end;

wherein said first input end and said second input end each respectively comprises a single one of said single-type transistors connected in series to said output end, wherein said front end is a pre-charge node including another single one of said single-type transistors also connected to said output node; and wherein the scan driving circuit is used for receiving control signals for signal outputting with different clocks so as to drive the display units of the liquid crystal display by combining wide pulse waves and narrow pulse waves input through said first and second input ends to obtain a driving signal at said output.

2. The scan driving circuit with single-type transistors of claim 1, wherein the first clock input bank has a plurality of input clocks.

3. The scan driving circuit with single-type transistors of claim 1, wherein the second clock input bank has a plurality for input clocks.

4. The scan driving circuit with single-type transistors of claim 1, wherein each of the logic circuit units is composed of a plurality of transistors, and each of the transistors is a P type transistor or an N type transistor.

5. The scan driving circuit with single-type transistors of claim 4, wherein the connection of a plurality of transistors in the logic circuit units comprises:

a first transistor connected to a signal input end of the front end via a gate of the first transistor, and connected to a second transistor via a drain of the first transistor;

a second transistor connected to a signal input end of the first input clock bank via a gate of the second transistor, and connected to the first transistor via a source of the second transistor, and connected to a third transistor via a drain of the second transistor;

a third transistor connected to a signal input end of the second input clock bank via a gate of the third transistor, and connected to the second transistor via a drain of the third transistor;

wherein the drain of the first transistor and the source of the second transistor are connected to the output end.

6. The scan driving circuit with single-type transistors of claim 5, wherein the drain of the third transistor is grounded or connected to its gate.

7. The scan driving circuit with single-type transistors of claim 4, wherein the front end of one of the plurality of logic circuit units is connected to the output end of another logic circuit unit.

8. A scan driving circuit with single-type transistors operated by inputting different signals to be processed and operated by a plurality of single-type transistors, the operation comprising the following steps:

inputting a plurality of banks of clock signals, the banks comprising a first clock input bank and a second clock input bank, and by means of the circuit connection in an array mode, the clock signals being inputted into a plurality of logic circuit units;

performing the processing of logic operations, the plurality of logic circuit units being used for outputting the control signals so as to drive the scanning;

driving the liquid crystal display units, the control signals outputted by the plurality of logic circuit units being used for driving the liquid crystal display units; and finishing the scanning by performing the above steps, wherein the plurality of logic circuit units are used for driving the liquid crystal display to perform the scanning, the process comprising the following steps:

maintaining the output of the control signals, a first transistor being used for continuously outputting high-level control signals;

receiving the clock signals, a second transistor and a third transistor being separately used for receiving the input clock signals of the first clock input bank and the input clock signals of the second clock input bank;

outputting the low-level control signals, the drains of the first transistor and second transistor being connected to each other, and when the second transistor and the third transistor output the low-level signals, restraining the first transistor from outputting the high-level control signals;

driving the liquid crystal display unit, the low-level control signals being used for driving the liquid crystal display units.

9. The scan driving circuit with single-type transistors of claim 8, wherein the first clock input bank has a plurality of input clocks, and each of the input clocks is separately inputted into a first input end (P) of each of the logic circuit units.

10. The scan driving circuit with single-type transistors of claim 8, wherein the second clock input bank has a plurality of input clocks, each of the input clocks is separately inputted into a second input end (Q) of each of the logic circuit units.

11. The scan driving circuit with single-type transistors of claim 8, wherein the plurality of logic circuit units for performing the logic operations are P type transistors.

12. The scan driving circuit with single-type transistors of claim 11, wherein the inputted plurality of banks of clock signals are low-level signals for controlling the plurality of logic circuits to perform the logic operations.

13. The scan driving circuit with single-type transistors of claim 8, wherein the drain of the third transistor is grounded or connected to its gate.

14. The scan driving circuit with single-type transistors of claim 8, wherein the plurality of logic circuit units for performing the logic operations are N type transistors.

15. The scan driving circuit with single-type transistors of claim 14, the inputted plurality of banks of clock signals are high-level signals for controlling the plurality of logic circuits to perform the logic operations.

16. The scan driving circuit with single-type transistors of claim 14, wherein the plurality of logic circuit units are used for driving the liquid crystal display to perform scanning, the process comprising:

maintaining the output of the control signals, the first transistor being used for continuously outputting the low-level control signals;

receiving the clock signals, a second transistor and a third transistor being used for separately receiving the input clock signals of the first clock input bank and the input clock signals of the second clock input bank;

outputting the high-level control signals, the drains of the first transistor and the second transistor being connected to each other, and when the second transistor and the third transistor output the high-level signals, restraining the first transistor from outputting the low-level control signals;

driving the liquid crystal display unit, the high-level control signals being used for driving the liquid crystal display units.

17. The scan driving circuit with single-type transistors of claim 16, wherein the drain of the third transistor is grounded or connected to its gate.

* * * * *